US006036037A

United States Patent [19]

Scheffer et al.

[11] Patent Number: 6,036,037

[45] Date of Patent: Mar. 14, 2000

[54] HOT FILL BOTTLE WITH REINFORCED HOOPS

[75] Inventors: Steven M. Scheffer; Martin E Ahern, both of Burlington; Boris W. K. Chiu, Hamilton, all of Canada

[73] Assignee: Twinpak Inc., Canada

[21] Appl. No.: 09/092,406

[22] Filed: Jun. 4, 1998

[51] Int. Cl.[7] ..... B65D 1/02; B65D 1/42; B65D 23/00

[52] U.S. Cl. ..... 215/381; 215/383; 220/666; 220/672; 220/675

[58] Field of Search ..... 215/381, 383, 215/382; 220/666, 675, 671, 672

[56] References Cited

U.S. PATENT DOCUMENTS

| | | | |
|---|---|---|---|
| D. 321,830 | 11/1991 | York et al. . | |
| D. 322,562 | 12/1991 | Narsutis . | |
| D. 347,391 | 5/1994 | Guertin . | |
| D. 366,417 | 1/1996 | Semersky . | |
| 4,805,788 | 2/1989 | Akiho | 215/381 |
| 5,054,623 | 10/1991 | Evenson . | |
| 5,279,433 | 1/1994 | Krishnakumar et al. | 215/381 |
| 5,337,909 | 8/1994 | Vailliencourt | 220/675 X |
| 5,704,503 | 1/1998 | Krishnakumar et al. . | |

*Primary Examiner*—Sue A. Weaver

*Attorney, Agent, or Firm*—Mark Kusner

[57] ABSTRACT

The invention provides a novel hot fill plastic container with reinforced bands above and below the vacuum panels to prevent panelling (or crease formation under vacuum after cooling) in the label supporting band area. The container has a substantially cylindrical recessed label supporting portion with multiple circumferentially spaced apart vacuum panels. Each panel includes a flat radially recessed central panel face which collapses radially inwardly under vacuum to reduce the volume of the container during cooling of the contents. A like multiple number of elongate posts are defined between the panels and generally reinforce the panel area, however, the top and bottom ends of the posts must be supported or else creases will form in these areas under vacuum. Accordingly, the invention provides for top and bottom cylindrical bands defining the axial upper and lower extent of the panels and posts. The bands include two or more axially spaced apart circumferential hoop ribs, and each rib is composed of recessed rib sections to interrupt the circumferential hoop rib. Each section in axial progression overlaps the adjacent sections of adjacent ribs to prevent crease formation and propagation between rib sections in the otherwise cylindrical band. Preferably, two or more ribs are distributed to substantially cover each band. Immediately adjacent the posts and panels, rib sections are disposed above and below each post since it has been found by experiment that the area of the bands most likely to develop creases are immediately above and below the posts.

19 Claims, 5 Drawing Sheets

HOT FILL BOTTLE WITH REINFORCED HOOPS

TECHNICAL FIELD

The invention is directed to a hot fill plastic blow molded bottle or container with recessed vacuum panels and reinforced bands with hoops above and below the panels for prevention of crease formation in the bands under vacuum during cooling of the contents.

BACKGROUND OF THE ART

Hot-fill bottles and other such containers are used to package liquids which must be stored and sealed in the container while hot to provide adequate sterilization. For example, containers of plastic are filled with liquid products under slight positive pressure and at temperatures approaching the boiling point of water. The bottles are immediately capped to ensure sterilization.

In the case of filling glass bottles in a like manner, the cooling of the liquid product usually creates a vacuum which collapses a flexible metal cap. However, due to the rigidity of the glass bottle, shrinkage of the product as it cools and creation of negative internal pressure does not significantly affect such rigid containers.

In the case of flexible plastic hot-fill containers, however, even slight negative internal pressure caused by cooling and gas volume reduction above the liquid product is a serious problem. Plastic bottles which are not adequately reinforced with structural enhancements are often unsuitable for hot-fill products since they collapse and create creases and ridges in the body of the flexible plastic bottles. Labels do not adhere and customers are hesitant to purchase products which appear as if they have been damaged.

Accordingly, the prior art includes several plastic bottles for hot-fill use which provide collapsible vacuum panels to accommodate the volume reduction on shrinkage of the hot-fill product.

U.S. Pat. No. 5,704,503 to Krishnakumar et al. issued Jan. 6, 1998 describes one such hot-fillable plastic container with collapsible panels under the label area. It has been found in the prior art that the provision of collapsible panels alone is generally insufficient to ensure shape integrity, adequate labeling and maintenance of the cylindrical label area. In U.S. Pat. No. 5,704,503, vertical reinforcing ridges and horizontal reinforcing bands are provided to enhance the structural rigidity of areas immediately adjacent to the collapsible panels.

Another example of collapsible panels is shown in U.S. Pat. No. 5,054,623 to Alberghini et al. In Alberghini, the inventor provides two rows of similar collapsible panels and a single triangular reinforcing ridge between the circumferential array of panels. Other examples are shown in U.S. Design Pat. No. 321,830 to York et al. and U.S. Design Pat. No. 366,417 to Semersky. Various designs have also been developed in the prior art including hoop reinforcing circumferential ridges for flexible plastic bottles. Examples are shown in U.S. Design Pat. No. 347,391 to Guertin and U.S. Design Pat. No. 322,562 to Narsutis.

It can be seen from the wide assortment of hot-fill bottle designs in the prior art that numerous combinations of: collapsible panels; reinforcing circumferential ridges; and axially extending posts, are used to to accommodate the vacuum of the cooled state and to maintain the substantially cylindrical shape of label areas of the bottle body.

Despite the complex designs proposed in the prior art, the inventors have found that collapse under vacuum still occurs in localized areas. Mold making costs rise dramatically when numerous ridges and complex shapes are machined in the mold surfaces. Structural viability of such shape complexities is often not based on clear scientific principles, but on trial and error. Not only must complex shapes in the plastic molds be produced at relatively high cost by skilled workers, but these shapes must be polished to produce a clear product with the desired surface finish and must be maintained in extremely good condition to ensure product quality. Design complexity also effects the flow of hot plastic during blow molding. In general, a simple bottle design, that accomplishes the purpose of allowing vacuum collapse in a controlled manner, is desirable in order to reduce manufacturing and maintenance costs.

An object of this invention is to rationalize the many complex designs of the prior art into a simple practical workable design. In this manner costs involved in producing molds and maintaining the quality of the resulting bottle are reduced.

It is a further purpose of the invention to provide a hot-fill bottle with capacity to reduce volume while retaining structural rigidity in a simple design which can be adapted to various shapes of hot-fill bottles.

DISCLOSURE OF THE INVENTION

The invention provides a novel hot fill plastic container with reinforced bands above and below the vacuum panels to prevent panelling (or crease formation under vacuum after cooling) in the label supporting band area.

The container has a substantially cylindrical recessed label supporting portion with multiple circumferentially spaced apart vacuum panels. Each panel includes a flat radially recessed central panel face which collapses radially inwardly under vacuum to reduce the volume of the container during cooling of the contents.

A like multiple number of elongate posts are defined between the panels and generally reinforce the panel area, however, the top and bottom ends of the posts must be supported or else creases will form in these areas under vacuum.

Accordingly, the invention provides for top and bottom cylindrical bands defining the axial upper and lower extent of the panels and posts. The bands include at least one, and preferably two or more axially spaced apart circumferential hoop ribs. Each rib is composed of recessed rib sections radially spaced about the circumferential hoop rib. Where two or more ribs are used, each section in axial progression overlaps the adjacent sections of adjacent ribs to prevent crease formation and propagation between rib sections in the otherwise cylindrical band.

Multiple ribs may be disposed to substantially cover each band depending on the hoop strength required and the provision made for application of labelling. Immediately adjacent the posts and panels rib sections are disposed above and below each post since it has been found by experiment that the area of the bands most likely to develop creases are immediately above and below the posts.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

The production of plastic containers using a blow-molded process is well known to those in the art and it is considered unnecessary herein to explain the process by which a preform is blow-molded in a conventional manner. However, U.S. Pat. No. 5,704,503 to Krishnakumar et al. issued Jan. 6, 1998 provides a full description of the prior art blow-molding process.

Figure 1:
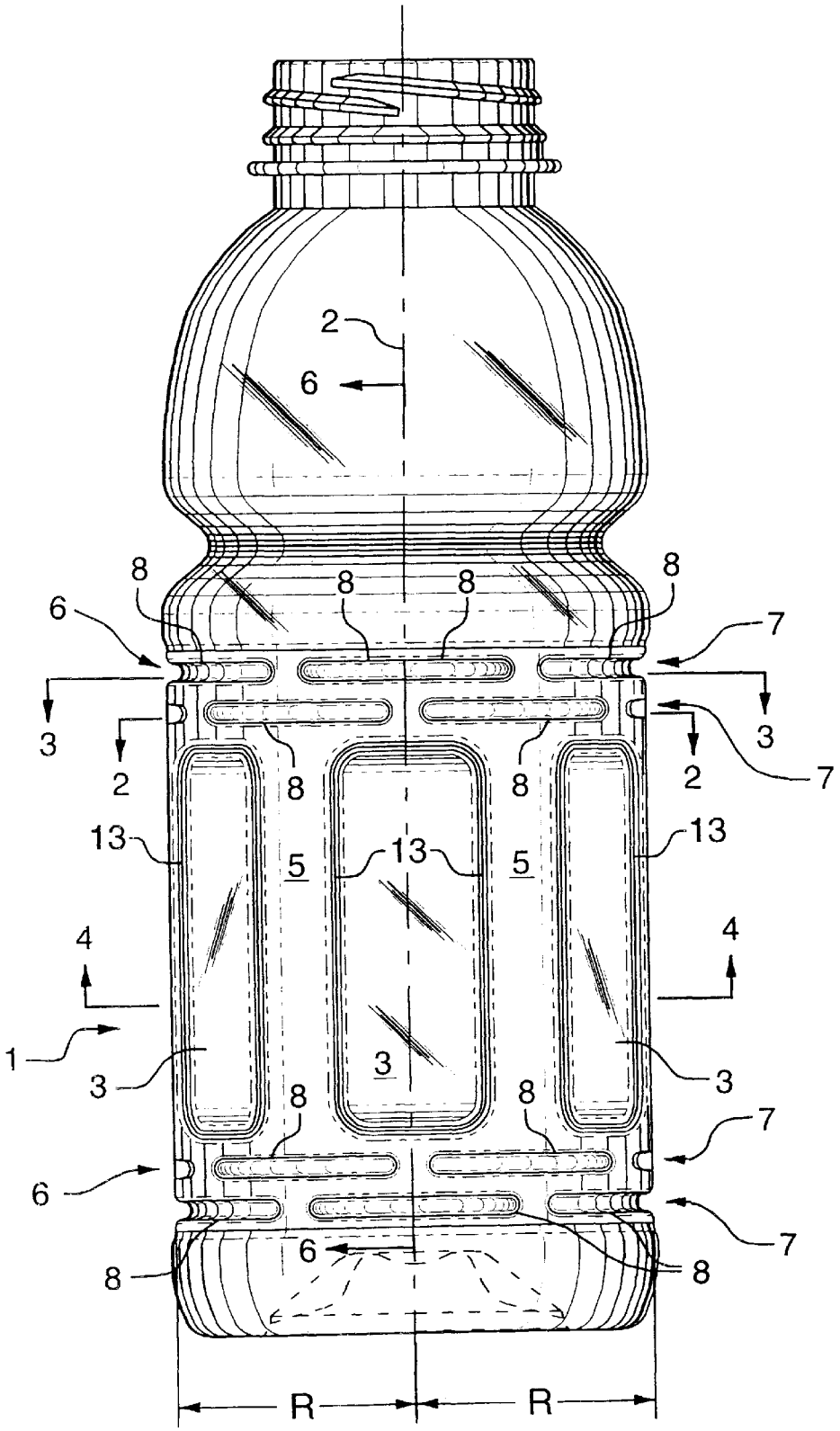
FIG. 1 is a frontal elevation view of a bottle container in accord with the invention showing details of the cylindrical label supporting portion with six vacuum panels and vertical posts therebetween, and particularly showing the top and bottom bands with two recessed ribs formed of six intermittent rib segments, the segments of adjacent ribs in an overlapping arrangement axially.

FIG. 1 illustrates a hot-fill plastic bottle container in accordance with the invention. On comparison with the prior art, it can be seen that the invention provides a much simplified recessed vacuum panel and plain posts between each panel, together with a reinforced band above and below the panels and posts.

The container includes a substantially cylindrical recessed label supporting portion 1 being symmetrical about a central axis 2 and having an outer circumference with container radius R.

Figure 4:
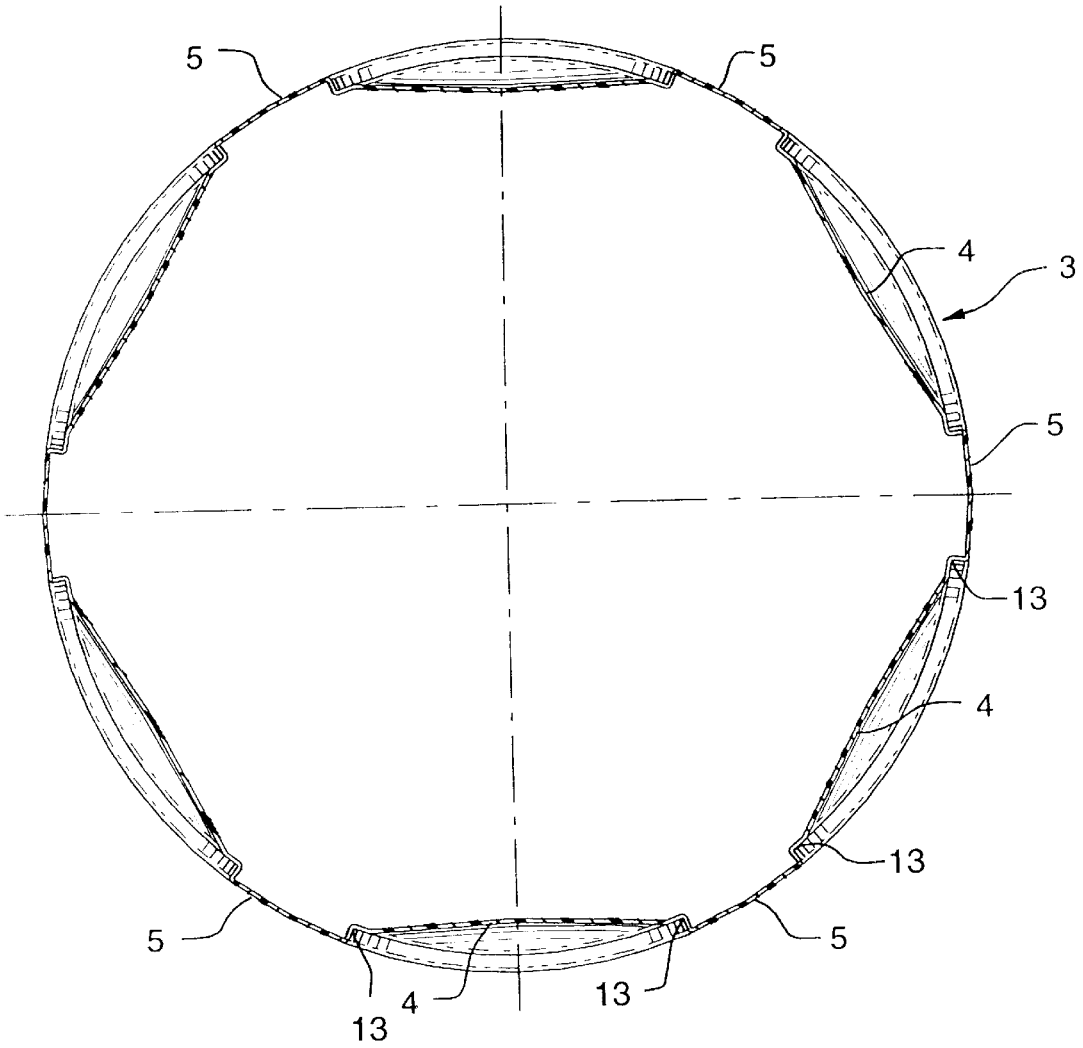
FIG. 4 is a radial sectional view along line 4—4 of FIG. 1.
Figure 5:
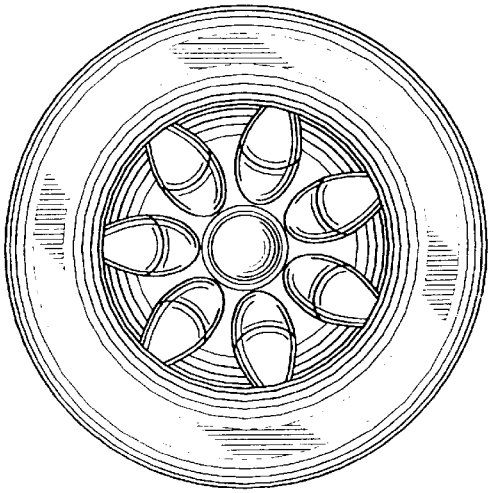
FIG. 5 is a bottom view of the bottle in FIG. 1.
Figure 6:
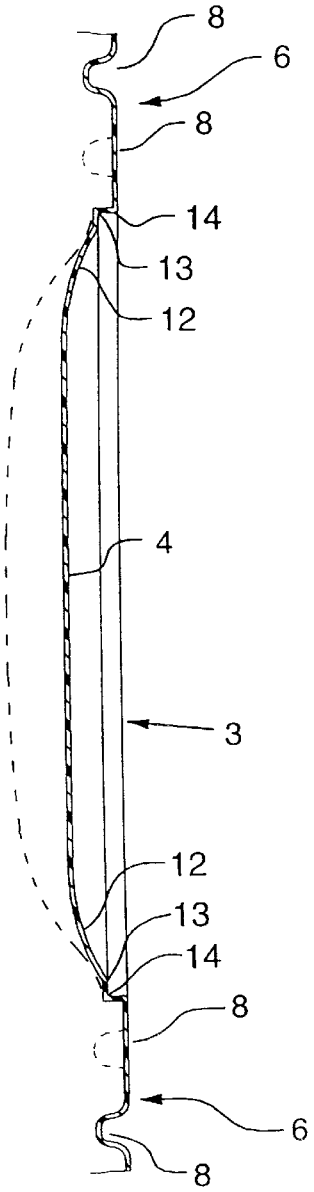
FIG. 6 is a partial axial sectional view along line 6—6 of FIG. 1.

The container as illustrated has six circumferentially spaced apart vacuum panels 3. As shown in FIGS. 6 and 4, the panels have a flat radially recessed central panel face 4. Between adjacent panels, elongate posts 5 are defined.

Top and bottom cylindrical bands 6 define the axially extent of the panels 3 and posts 5. The bands 6 and external surfaces of the posts 5 define a cylindrical recessed label supporting portion. The panels 3 are recessed radially inward from that cylindrical label supporting surface. The bands 6 also include in the embodiment illustrated in FIGS. 1–7, two axially spaced apart circumferential hoop ribs 7. Each rib 7 is made up of six recessed rib sections 8 as can been seen in FIGS. 1 and FIG. 6. Each section 8 overlaps the adjacent sections 8 of adjacent ribs 7 in axially progression. In the alternative embodiment shown in FIG. 8, one rib 7 is provided in each band 6. The remaining ⅔ area of the band 6 comprises a glue land for ensuring adherence of labels.

In respect of the two rib 7 embodiment, it has been found by experiment that overlapping the rib sections 8 of axially stacked ribs 7, provides an adequate degree of reinforcement and supports the cylindrical label in a manner superior to a simple singular continuous rib. The preferred location for intermittent rib sections 8 in the ribs 7 is to dispose the intermittent sections 8 above and below each posts. It has been found where tests are conducted on bottles with no reinforcement in the bands 6, that the zone of crease formation and bottle collapse is primarily in the band 6 immediately adjacent the top and bottom ends of the posts 5. By placing the intermittent segments 8 immediately above and below the posts in the first row of ribs 7, superior reinforcement of this important area is provided in a simple and cost effective manner. This disposition of rib segments 8 is used in both embodiments with one rib 7 (FIG. 8) or two ribs 7 (FIG. 1).

For label placement a completely cylindrical surface is generally preferred. However, due to the collapsing under vacuum of the bottle, some type of hoop reinforcement is required. Since the area under the label is not seen by the purchaser, this area is typically used for the vacuum panel and reinforcement location.

It has been found that a desirable balance between the requirements of the label and the requirements of vacuum reinforcement are provided by intermittent sections 8. Intermittent sections substantially maintain the cylindrical backing support for the label and also provide adequate reinforcement in important areas of the cylindrical recess label supporting portion of the body. In particular, reinforcement is provided at the intersection between the posts 5 and the bands 6, by placement of two or more overlapping rows of rib sections 8.

Figure 7:
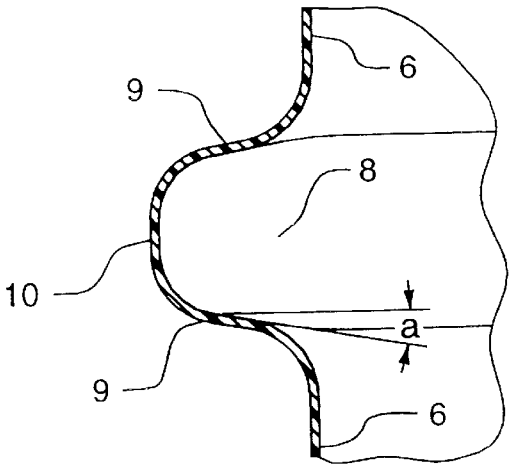
FIG. 7 is a detail axial sectional view of a typical rib segment.
Figure 8:
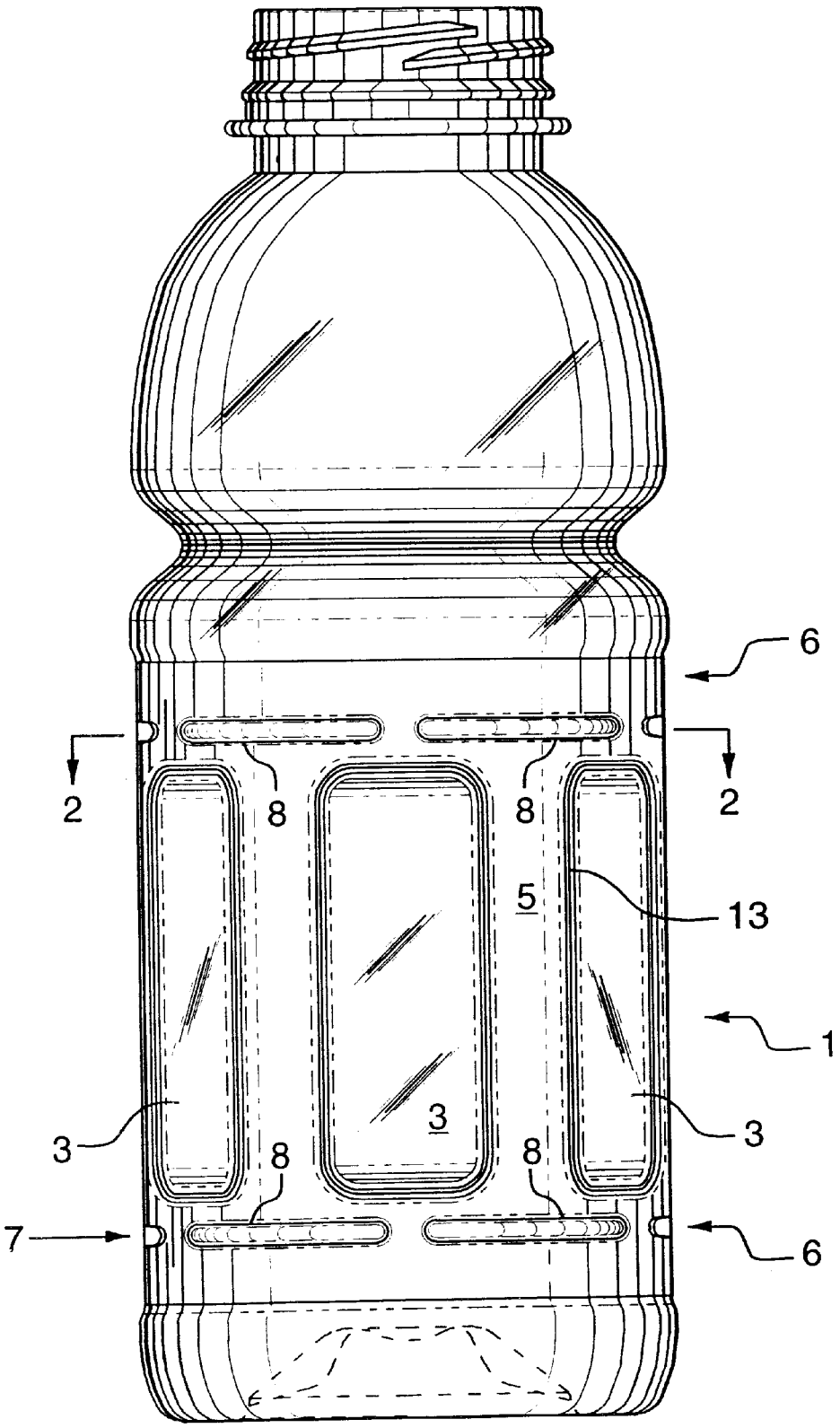
FIG. 8 is a view similar to FIG. 1 showing an alternative embodiment with one circumferential rib.

As shown in FIG. 1, the two hoop ribs 7 and constituent sections 8 substantially cover the surface of each band 6. With reference to FIG. 6 and 7, it can be seen that the recessed rib sections 8 have arcuate edges. The cumulative effect of the overlapping sections 8 with arcuate edges are to define an undulating band surface in axial section as shown at the top and bottom of FIG. 6.

The details of the rib sections 8 are shown in FIG. 7. As will be appreciated by those skilled in the art, the process of blow-molding requires that any sharp edges be provided with a radius to round off the edges and ensure proper molding with a uniformly thick wall resulting. FIG. 7 shows the detail of the final blow-molded wall in the area of the rib sections 8. Arcuate edges are defined between an outwardly tapered perimeter wall 9 and a recessed base 10. The degree of taper is indicated as angle 'a' which preferably is approximately 10° to allow for stripping of the mold. Smooth transitions between the band 6, tapered perimeter walls 9 and recessed base 10 are ensured by providing a relatively large radius on the edges to generate an arcuate shape.

Figure 2:
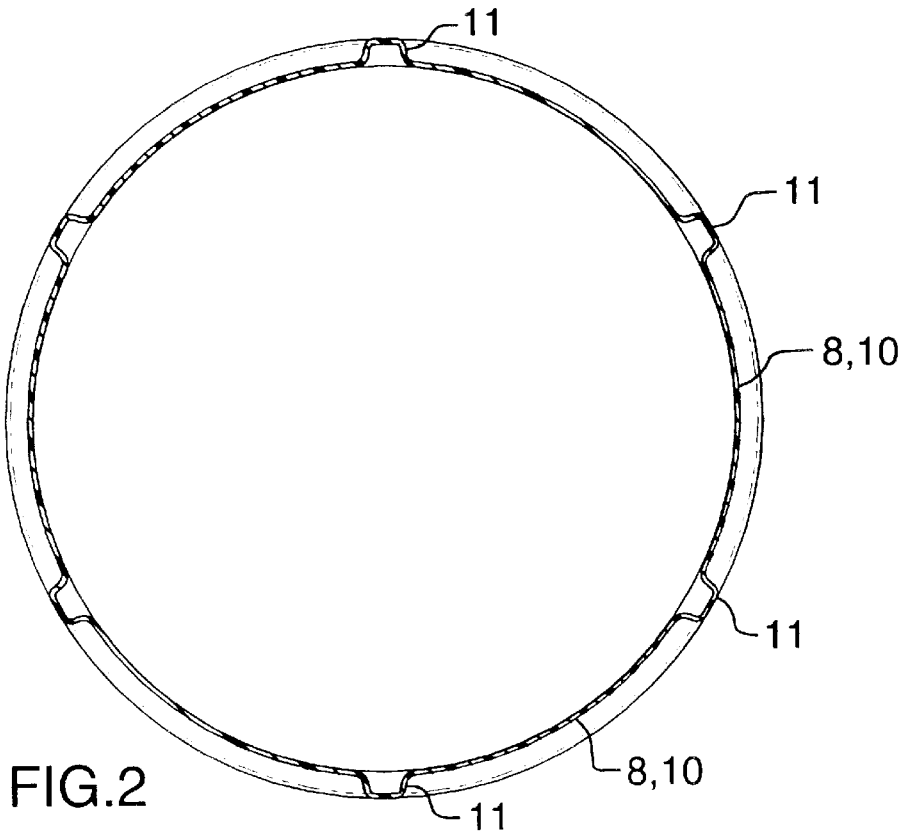
FIG. 2 is a radial sectional view along line 2—2 of FIG. 1.
Figure 3:
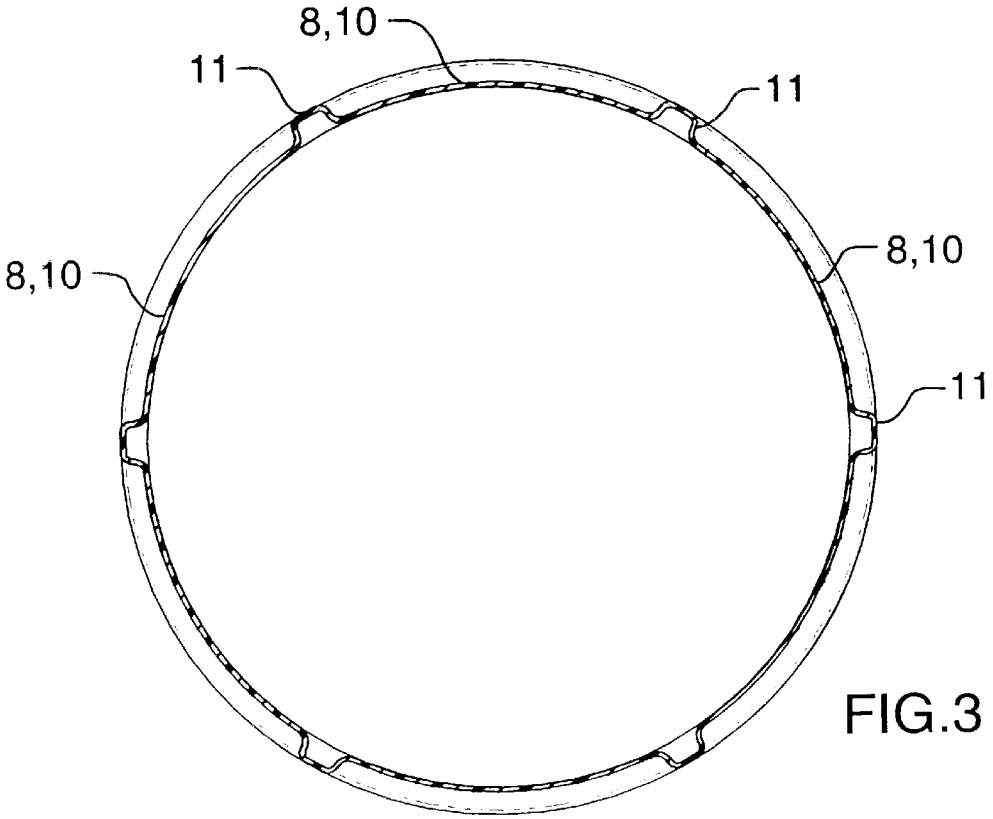
FIG. 3 is a radial sectional view along line 3—3 of FIG. 1.

FIGS. 2 and 3 illustrate in sectional view the staggering or overlapping of the segments 8 with short stubs 11 between segments 8 acting as means to maintain the outer cylindrical surface as well as providing a degree of axial reinforcement.

Although in the embodiment illustrated, the number of panels 3, posts 5 and sections 8 in each rib 7 is six, it will be appreciated that the number chosen is primarily a design decision. However, for simplicity of mold construction, it is expected that the preferred number of panels 3, posts 5 and sections 8 will be selected from either four, six or eight multiples.

As best seen in FIGS. 6, the panels 3, although having a substantially flat panel face 4, are not entirely flat throughout, but include flat panel faces 4 merging with convex top and bottom sections 12. Each panel 3 also includes an outer recessed frame 13. The recessed frame 13 has preferably right angle peripheral edges defined at radially inward and outward ends of a radially peripheral wall 14.

The relatively abrupt right angle transition between the cylindrical bands 6, the radially peripheral wall 14 and recessed frame 13, provides a break in the uniform surface of the bottle acting in a manner similar to a hinge as indicated in dashed outline in FIG. 6. When the volume of the hot product inside the bottle shrinks during cooling, the flat face of the panel 4 is drawn radially inwardly as indicated in dashed outline. The sharp corners of the frame 13 and peripheral wall 14 prevent crease formation and propagation of deformation from the panels 3 into the bands 6 and also tend to reinforce the hoop strength of the bands 6 in addition to the reinforcing sections 8. The convex top and bottom sections 12 of the flat panel faces 4 enable a hinging action at the outer extremities of the peripheral wall 14 and provide for smooth deformation of the flat panel face 4 during vacuum deformation.

As described above, the invention provides an improved reinforced hot-fill plastic container. The flexible walls of a plastic container would collapse and form creases in an uncontrolled manner unless provision is made to allow for controlled collapse as volume reduces during cooling. It is also important to maintain the round shape of the label supporting area, in particular the band area 6 immediately adjacent to the top and bottom ends of the reinforcing posts 5.

The invention provides a superior reinforcing for the band area 6 in a simple manner avoiding the complexity of mold designs present in the prior art. The multiple circumferential ridges 7 provide improved band 6 reinforcement and maintain the important round shape for label support. Interrupted ribs 7 are produced with individual sections 8 providing a undulating surface that maintains an outer cylindrical support for label attachment. The cumulative effect of the rounded or arcuate edges of multiple staggered recessed sections 8 is a blistered or undulating surface that provides superior reinforcement and sufficient support for a cylindrical label.

The simple design of the invention eliminates the cost of manufacturing complex molds and reduces maintenance. Simple substantially flat panels 3 are provided with a hinging action with a sharply recessed peripheral wall 14. Propagation of creases and vacuum deformation are prevented between the panels 3 and the bands 6 by provision of a relatively sharp transition between the edges of the panel 3 using a recessed frame 13 and radial peripheral wall 14. Collapse of the transition area between the posts 5 and substantially cylindrical band areas 6 is prevented by placement of the ribs 7 with individual segments 8 immediately above the top and bottom ends of each post 5.

Although the above description and accompanying drawings relate to a specific preferred embodiment as presently contemplated by the inventors, it will be understood that the invention in its broad aspect includes mechanical and functional equivalents of the elements described and illustrated.

The embodiments of the invention in which an exclusive property or privilege is claimed are defined as follows:

1. A hot fill plastic container with a substantially cylindrical recessed label supporting portion with central axis, container radius and outer circumference, said portion comprising:

a plurality of circumferentially spaced apart vacuum panels, each panel including a flat radially recessed central panel face;

a plurality of elongate posts defined between the panels; and top and bottom cylindrical bands defining the axial extent of the panels and posts, wherein the bands each include a circumferential hoop rib, each rib comprising a plurality of recessed rib sections, the bands including at least two hoop ribs and a circumferential glue land wherein each section in axial progression overlaps the adjacent sections of adjacent ribs.

2. A container in accordance with claim 1 wherein the ribs immediately adjacent the posts and panels have sections disposed above and below each post.

3. A container in accordance with claim 1 wherein a plurality of hoop ribs substantially cover each band.

4. A container according to claim 1 wherein the bands include two hoop ribs and a circumferential glue land wherein each section in axial progression overlaps the adjacent sections of adjacent ribs.

5. A container in accordance with claim 1 wherein the rib sections have arcuate edges defining an undulating band surface in axial section.

6. A container in accordance with claim 5 wherein the rib sections have arcuate edges defined between an outwardly tapered perimeter wall and a recessed base, and between the tapered perimeter wall and band.

7. A container in accordance with claim 1 wherein the number of panels, posts and sections in each rib is selected from the group consisting of: four; six; and eight.

8. A container in accordance with claim 7 wherein the number of panels, posts and sections in each rib is six.

9. A container in accordance with claim 1 wherein the panels have flat panel faces merging with convex top and bottom sections.

10. A container in accordance with claim 9 wherein each panel includes an outer recessed frame.

11. A container in accordance with claim 10 wherein the recessed frame of each panel has right angle peripheral edges defined at radially inward and outward ends of a radial peripheral wall.

12. A container in accordance with claim 1 wherein the container is a substantially transparent biaxially oriented blow-molded polyester container.

13. A container in accordance with claim 12 wherein the polyester is polyethylene terephtalate.

14. A hot fill plastic container with a substantially cylindrical recessed label supporting portion with central axis, container radius and outer circumference, said portion comprising:

a plurality of circumferentially spaced apart vacuum panels, each panel including a flat radially recessed central panel face;

a plurality of elongate posts defined between the panels, each post having a cylindrical segment inner and outer surface without substantial surface discontinuity; and top and bottom cylindrical bands defining the axial extent of the panels and posts, wherein the bands each include a circumferential hoop rib, each rib comprising a plurality of recessed rib sections.

15. A container in accordance with claim 14 wherein the ribs immediately adjacent the posts and panels have sections disposed above and below each post.

16. A container in accordance with claim 14 wherein a plurality of hoop ribs substantially cover each band.

17. A container in accordance with claim 14 wherein the bands include at least two hoop ribs and a circumferential glue land wherein each section in axial progression overlaps the adjacent sections of adjacent ribs.

18. A container in accordance with claim 14 wherein the rib sections have arcuate edges defining an undulating band surface in axial section.

19. A container in accordance with claim 18 wherein the rib sections have arcuate edges defined between an outwardly tapered perimeter wall and a recessed base, and between the tapered perimeter wall and band.

* * * * *